United States Patent [19]

Trojohn

[11] 4,384,384

[45] May 24, 1983

[54] GOLF CLUB CLEANING DEVICE

[76] Inventor: John W. Trojohn, 7316 Cornelia Dr., Edina, Minn. 55435

[21] Appl. No.: 283,087

[22] Filed: Jul. 13, 1981

[51] Int. Cl.[3] ..... A46B 17/02

[52] U.S. Cl. ..... 15/146; 15/160

[58] Field of Search ..... 15/159 R, 160, 161, 15/112, 104.92, 176, 146, 246

[56] References Cited

U.S. PATENT DOCUMENTS

| | | | |
|---|---|---|---|
| 2,871,499 | 2/1959 | Gardner | 15/160 X |
| 3,065,478 | 11/1962 | Lawrin | 15/112 |
| 3,631,560 | 1/1972 | Atkins | 15/146 |
| 4,069,536 | 1/1978 | Hartz et al. | 15/104.92 |

FOREIGN PATENT DOCUMENTS

| | | | |
|---|---|---|---|
| 1503844 | 5/1969 | Fed. Rep. of Germany | 15/161 |
| 313517 | 6/1956 | Switzerland | 15/160 |

*Primary Examiner*—Peter Feldman

*Attorney, Agent, or Firm*—Schroeder, Siegfried, Vidas, Steffey & Arrett

[57] ABSTRACT

An efficient, durable and inexpensive golf club cleaner comprises a pair of superimposed and connected plate-like brush-supporting members wherein one plate-like member is provided with a large centrally disposed rectangular recess and the other, which is substantially smaller, is provided with a registering central opening which is defined by a frame-like recess in the smaller plate-like member which is adapted to overlie and secure the edges of the back of a rectangular brush that is disposed in the aforementioned recess with the bristles of the brush extending through and projecting from the aforementioned opening. Means are provided for securing the smaller plate-like member to the larger plate-like member when the former is in assembled position; and also means for firmly attaching the larger plate-like member to a suitable support.

5 Claims, 4 Drawing Figures

GOLF CLUB CLEANING DEVICE

This invention relates to devices for cleaning the faces or ball-hitting areas of golf clubs.

Since the grooves which extend across the faces of golf clubs control to a substantial extent the movement of a golf ball whether it is on the ground or in the air, it is very important that these grooves be kept clean and free of dirt and/or impacted grass which rapidly build-up in the grooves and tend to make the faces of the clubs grooveless and smooth.

Many devices have heretofore been proposed for cleaning the faces of golf clubs, but for the most part these prior art devices are characterized by one or more objectionable features, such as lack of efficiency, durability, inexpensiveness, resistence to being easily misplaced, etc.

It is among the objects of this invention to provide a highly efficient golf club cleaning device which effectively overcomes the disadvantages described.

The foregoing and other objects and advantages will appear from the following description and annexed drawings in which like reference characters designate like parts and wherein.

Figure 1:
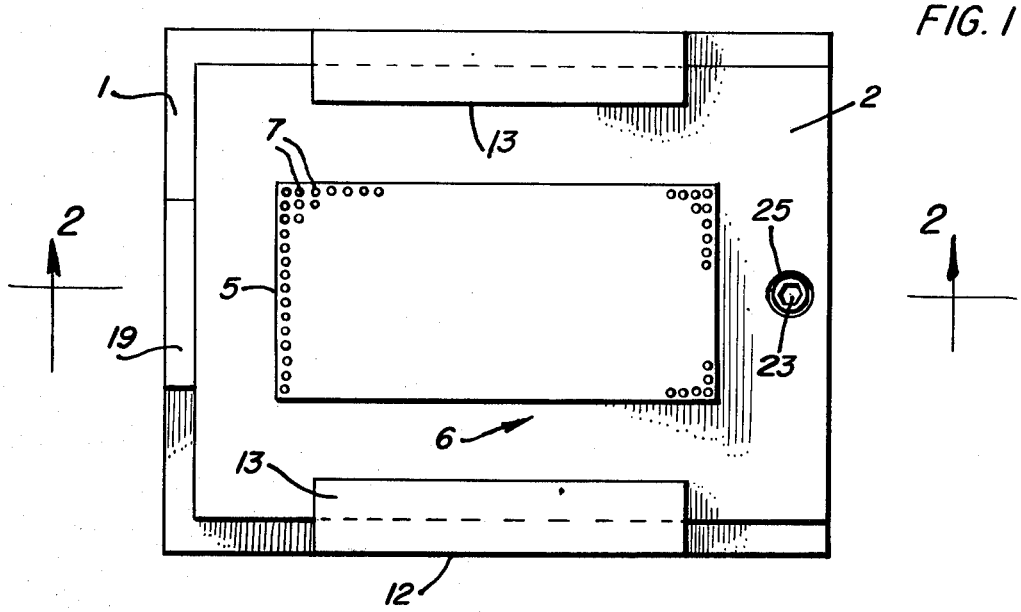
FIG. 1 is a plan view of a device which embodies the teachings of the invention as mounted in operative position on a vertical post or other suitable support (not shown).

Referring more particularly to the drawings, the reference numeral 1 designates the inner and larger of a pair of cooperating rectangular plate-like members, the outer and smaller plate-like member being indicated at 2.

These cooperating rectangular plate-like members 1 and 2 may be formed of any suitably rigid material such as metal or heavy-duty plastic. The outer and smaller of the cooperating rectangular plate-like member 2 is provided with a large centrally disposed rectangular aperture 5, and a correspondingly shaped brush, generally indicated at 6, is centrally disposed on the inner and larger plate-like member 1 with its bristles 7 extending through and projecting from said aperture.

The inner and larger rectangular plate-like member 1 is provided on each of its side edges with a centrally disposed relatively short upwardly extending rib having an integrally formed inwardly extending flange of approximately the same dimensions, thus providing a clip for overlying and contacting the correspondingly located portions of the side edges of the outer and smaller rectangular plate-like member 2 when disposed in assembled relationship. Each of the clips formed by an upwardly extending rib 12 and right-angular flange 13 may be struck-up from the material of the inner rectangular plate-like member 1, thus leaving an elongated opening 15 therein.

Figure 2:
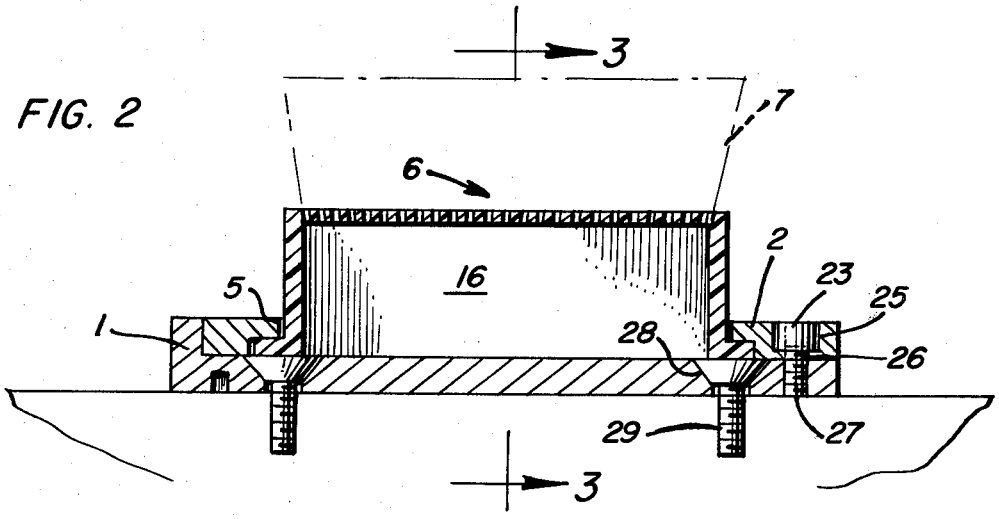
FIG. 2 is a sectional elevation taken on the line 2—2 of FIG. 1.
Figure 3:
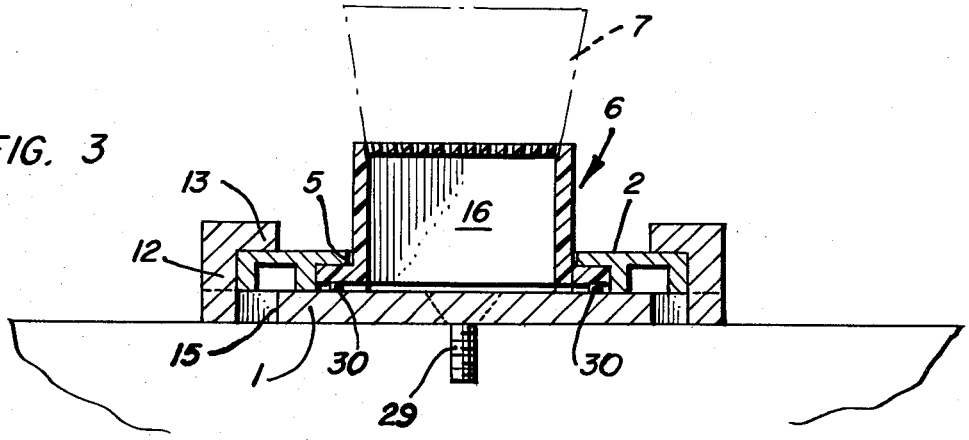
FIG. 3 is a sectional elevational view taken on the line 3—3 of FIG. 2.

Referring to FIG. 2 and FIG. 3, and the intermediate portion of the exploded view of FIG. 4, the aforementioned brush member generally indicated at 6 comprises a rectangular base member 16 below the mass of cleaning bristles 7 which fairly snugly occupies the centrally disposed rectangular aperture 5 in the outer and smaller rectangular plate-like member 2, said rectangular base member 16 possessing substantially straight side-walls which terminate at their lower ends in a continuous flat flange 18 which is of even width and thickness throughout.

As will be understood from the foregoing, when the brush member 6 is in mounted position its rectangular base 16 and continuous flat flange 18 contact the central portion of the outer face of the inner and larger plate-like member 1; and the pressure of those portions of the outer and smaller plate-like member 2 which surround its central aperture or opening 5 firmly secure the brush member 6 against movement.

Figure 4:
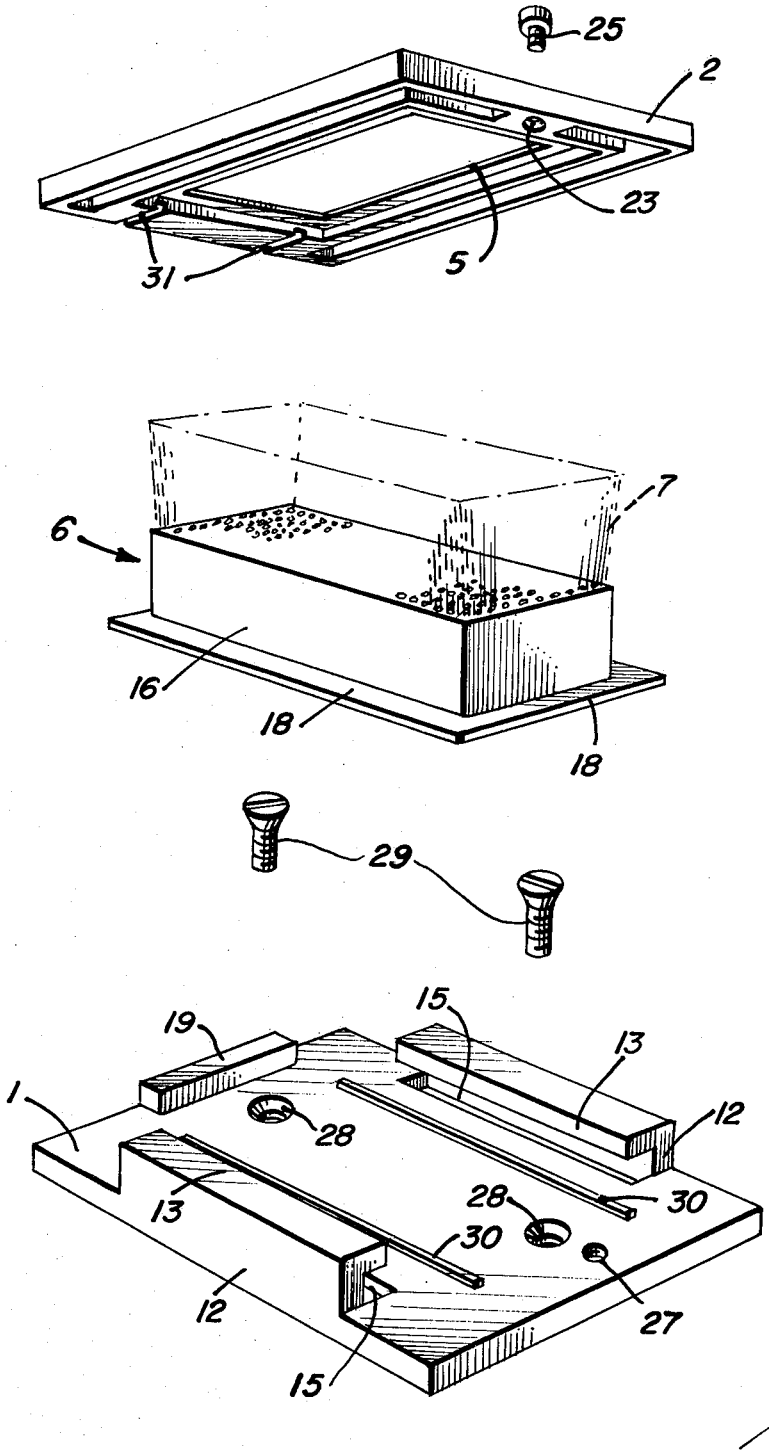
FIG. 4 is an exploded view illustrating all of the elements of the device of the invention.

As viewed in FIGS. 1 and 2, and the lowermost portion of the exploded view of FIG. 4, the left-hand edge of the inner plate-like member 1 is provided with a vertically extending rectangular stop member 19 for contacting the corresponding edge of the outer and smaller rectangular plate-like member when it is slidably moved into position between the clips formed by the upwardly extending ribs 2 and their integral inwardly extending flanges 13.

As viewed in FIGS. 1 and 2, and the uppermost portion of exploded view of FIG. 4, the right-hand edge of the outer and smaller rectangular plate-like member is provided on its longitudinal center-line with an aperture 23 for receiving a screw 25 which extends into an aligned aperture 27 in the corresponding portion of the lower rectangular plate-like member 2. This screw 25 is shown in FIG. 2 as having a cylindrical head with an Allen-wrench recess therein (see FIG. 1); and the lower edge of this cylindrical head may engage a cylindrical ledge 26 adjacent the bottom of the aperture 23.

The threaded portion of the screw 25 is shown (FIG. 2) as projecting from the lower end of the aperture 23 and into screw-threaded engagement with the side-wall of the aperture 27 in the inner rectangular plate-like member.

It is contemplated that, as an alternative, the aperture 27 may be smooth-sided, and the screw 25 of such length and shape as to project from the lower end of the aperture 27 and engage the material (wood post etc.) of the supporting element for the golf club cleaning device. Also, that the head of the screw 25 may be of other than the Allen-type.

As shown most clearly in FIG. 2 and the lowermost portion of the exploded view of FIG. 4, the inner rectangular plate-like member 1 may be provided with countersunk apertures 28 for receiving screws 29 with countersunk heads for attaching said plate-like member 1 to the aforementioned supporting element for the golf club cleaning device.

Referring to FIG. 3 and the lowermost portion of the exploded view of FIG. 4, the upper surface of the inner plate-like member 1 may be provided with a pair of parallel rails 30 adjacent the clip formed by the upwardly extending rails 12 and their integral outwardly extending flanges 13. These parallel rails 30 are shown as receivable in correspondingly shaped recesses 31 in the inner face of the outer rectangular plate-like member 2.

According to the foregoing illustrative embodiment of the invention, the brush generally indicated at 6 may be quickly and easily fitted in the rectangular recess 5 in the outer or upper plate-like member 2 with bristles 7 protruding outwardly therefrom as shown; the plate-like member 2 with brush 6 intact for slidably moving along the outer base of the inner plate-like member 1 and under the clips provided by the elements 12–13 until the stop member 19 is contacted; and the set-screw 25 then secured in position. When so assembled, the flange 18 surrounding the bottom of the base member 16 of the brush 6 is securely gripped between the correspondingly adjacent surfaces of the inner and outer plate-like members 1 and 2.

Having thus described the invention what I claim as new and desire to secure by Letters Patent is:

1. A golf club cleaning device comprising a pair of separable substantially rectangular plate-like cooperating brush-holding members adapted for face-to-face contact, (a) one of said plate-like rectangular brush-holding members being adapted for attachment to a supporting member (b) the other of said plate-like brush-holding members having a centrally disposed rectangular aperture (c) a brush having a substantially rectangular back member which is of such size and shape as to snugly occupy the centrally disposed aperture in said second-named plate-like brush-holding member with the bristles extending through and projecting from the aforementioned centrally disposed aperture (d) flanges extending from the sides and ends of the substantially rectangular back member of said brush (e) the bottom of said substantially rectangular back member of said brush and the adjacent faces of said flanges being in contact with the adjacent surfaces of said first-named plate-like brush-holding member (f) the inner surfaces of the second-named plate-like member which surround the centrally disposed rectangular aperture therein being in overlying contact with the adjacent surfaces of the flanges on the rectangular back member of said brush (g) means for attaching the first-named plate-like member to a suitable support, and (h) means for fastening the second-named plate-like member to said first-named plate-like member.

2. The combination of claim 1 wherein the means fastening the second-named plate-like member to the first-named plate-like member comprises a pair of opposed clips on the first-named plate-like member which overlie and contact the adjacent edges of the second-named plate-like member.

3. The combination of claim 1 wherein the means fastening the second-named plate-like member to the first-named plate-like member comprises a pair of opposed clips on the opposing side edges of the first-named plate-like member which overlie and contact the adjacent surfaces of the second-named plate-like member.

4. The combination of claim 2 together with means for preventing the sliding movement of said second-named plate-like member with respect to said first-named plate-like member.

5. The combination of claim 4 wherein the means for preventing the sliding movement of said second-named plate-like member with respect to said first-named plate-like member comprises a stop member carried by and disposed adjacent one end of said first-named plate-like member, and a set-screw connecting said plate-like members.

* * * * *